United States Patent [19]

Haines-Keeley et al.

[11] Patent Number: 4,882,914

[45] Date of Patent: Nov. 28, 1989

[54] BEVERAGE COOLER

[76] Inventors: Susan M. Haines-Keeley, 8101 83rd Ave., SW., B-12, Tacoma, Wash. 98498; Wanita E. Haines, P.O. Box 1104, Havre, Mont. 59501

[21] Appl. No.: 320,518

[22] Filed: Mar. 8, 1989

[51] Int. Cl.[4] ..... F25D 3/08

[52] U.S. Cl. ..... 62/457.4; 62/530

[58] Field of Search ..... 62/457, 530, 457.4

[56] References Cited

U.S. PATENT DOCUMENTS

| | | | |
|---|---|---|---|
| 4,324,111 | 4/1982 | Edwards | 62/530 X |
| 4,344,303 | 8/1982 | Kelly, Jr. | 62/457 X |
| 4,741,176 | 5/1988 | Johnson et al. | 62/457 |
| 4,768,354 | 9/1988 | Barnwell | 62/457 |
| 4,793,149 | 12/1988 | Riche | 62/530 X |

*Primary Examiner*—Lloyd L. King

*Attorney, Agent, or Firm*—Jerry T. Kearns

[57] ABSTRACT

A beverage cooler for holding and cooling a beverage container has a generally cylindrical body formed from sponge rubber and having open top and bottom ends connected by a hollow interior. A plurality of polyethylene receptacles are spaced around the side wall of the body and are encapsulated therein. The receptacles are preferably filled wtih a gel refrigerant for cooling a beverage can. The cooler is expandable to securely hold a beverage container and to adapt to various different standard sizes of beverage cans and bottles.

1 Claim, 3 Drawing Sheets

BEVERAGE COOLER

BACKGROUND OF THE INVENTION

1. Field of the Invention

The present invention relates to beverage coolers, and more particularly pertains to a beverage cooler of the type utilized for holding and cooling individual beverage cans and bottles. Various types of beverage coolers for individual beverage containers have been widely used. One common form utilizes a styrofoam cup for surrounding a beverage can. The problem with such rigid coolers is that they do not adequately hold the can and are not adaptable for use with different standard sized beverage containers, for example 12 ounce cans and 16 ounce bottles. In order to overcome this problem, the present invention provides an expandable body adaptable for both of these different standard sized beverage containers and including a plurality of encapsulated refrigerant filled receptacles for cooling the beverage container contents for a relatively long amount of time.

1. Description of the Prior Art

Various types of beverage coolers are known in the prior art. A typical example of such a beverage cooler is to be found in U.S. Pat. No. 4,357,809, which issued to E. Held et al on Nov. 9, 1982. This patent discloses a beverage cooler having an inner receptacle defined by a closed bottom end, an open upper end and generally cylindrical side wall. A gel refrigerant is encapsulated within the cylindrical side wall of the receptacle for cooling the contents. The cooler is formed from a rigid non expandable material and is not adaptable for use with various different sizes of beverage containers. U.S. Pat. No. 4,383,422, which issued to J. Gordon et al on May 17, 1983, discloses an insulated holder for beverage containers having a generally cup-shaped open top compartment for receiving a chilled beverage container, dimensioned such that the side walls of the holder are spaced from the container side walls through the major portion of the length of the compartment. A flexible sealing member engages the side walls of the beverage container at the upper end of the compartment to form an air tight sealed insulating space within the compartment. Additional insulation is provided in the walls of the holder. The lower portion of the holder may include a separate compartment which stores a refrigerant which engages the bottom of the beverage container in conductive heat transfer relation. U.S. Pat. No. 4,393,665, which issued to J. Gardner et al on July 19, 1983, discloses a server for wine bottles which includes a cup-shaped receptacle having a side wall formed from a heat conductive metal and a bottom ice receptacle in contact with a bottom surface of an inserted wine bottle. U.S. Pat. No. 4,517,815, which issued to P. Basso on May 21, 1985, discloses an insulated modular cooler including a plurality of tubular housing sections connected by cooperating threads in end to end relation. A refrigerant may be encapsulated in the cylindrical side walls of the housing sections. U.S. Pat. No. 4,570,454, which issued to L. Campbell on Feb. 18, 1986, discloses a double walled drinking vessel having a heat maintenance chamber between an inner and outer transparent wall. A fluid is placed between the walls and this fluid is either heated or cooled depending upon the beverage that is to be served in the vessel.

While the above mentioned devices are suited for their intended usage, none of these devices disclose a beverage cooler for holding and cooling an individual beverage container which is formed from an expandable material for use with various different sizes of beverage containers. Inasmuch as the art is relatively crowded with respect to these various types of beverage coolers, it can be appreciated that there is a continuing need for and interest in improvements to such beverage coolers, and in this respect, the present invention addresses this need and interest.

SUMMARY OF THE INVENTION

In view of the foregoing disadvantages inherent in the known types of beverage coolers now present in the prior art, the present invention provides an improved beverage cooler. As such, the general purpose of the present invention, which will be described subsequently in greater detail, is to provide a new and improved beverage cooler which has all the advantages of the prior art beverage coolers and none of the disadvantages.

To attain this, a representative embodiment of the concepts of the present invention is illustrated in the drawings and makes use of a beverage cooler for holding and cooling a beverage container having a generally cylindrical body formed from sponge rubber and having open top and bottom ends connected by a hollow interior. A plurality of polyethylene receptacles are spaced around the side wall of the body and are encapsulated therein. The receptacles are preferably filled with a gel refrigerant for cooling a beverage can. The cooler is expandable to securely hold a beverage container and to adapt to various different standard sizes of beverage cans and bottles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage cooler which has all the advantages of the prior art beverage coolers and none of the disadvantages.

It is another object of the present invention to provide a new and improved beverage cooler which may be easily and efficiently manufactured and marketed.

It is a further object of the present invention to provide a new and improved beverage cooler which is of a durable and reliable construction.

An even further object of the present invention is to provide a new and improved beverage cooler which is susceptible of a low cost of manufacture with regard to both materials and labor, and which accordingly is then susceptible of low prices of sale to the consuming public, thereby making such beverage coolers economically available to the buying public.

Still yet another object of the present invention is to provide a new and improved beverage cooler which provides in the apparatuses and methods of the prior art some of the advantages thereof, while simultaneously overcoming some of the disadvantages normally associated therewith.

Still another object of the present invention is to provide a new and improved beverage cooler for holding and cooling an individual beverage container.

Yet another object of the present invention is to provide a new and improved beverage cooler for holding and cooling a beverage container which is expandable to adapt to various different beverage container sizes.

Even still another object of the present invention is to provide a new and improved beverage cooler for holding and cooling a beverage container which utilizes a plurality of gel refrigerant receptacles encapsulated within a stretchable body adapted to receive various different sizes of beverage containers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
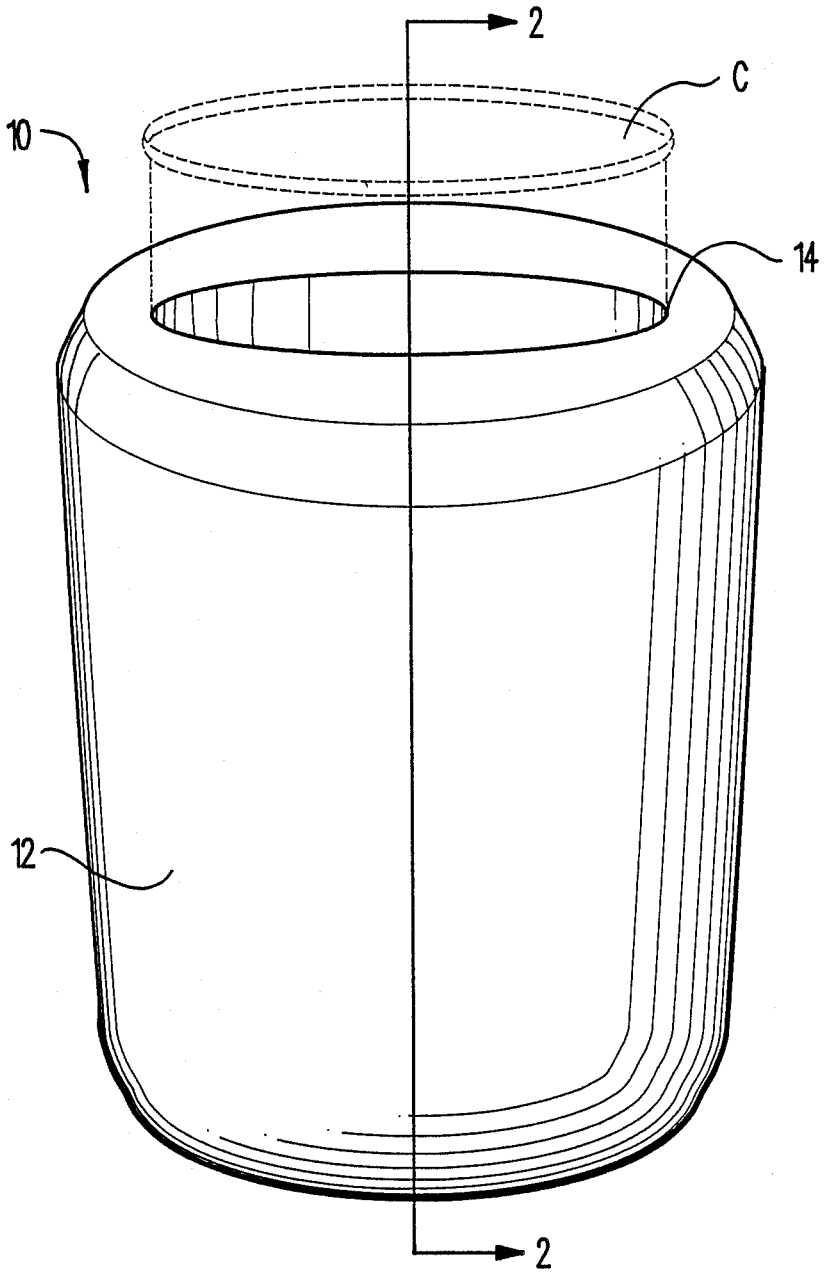
FIG. 1 is a perspective view of the beverage cooler according to the present invention.

With reference now to the drawings, and in particular to FIG. 1 thereof, a new and improved beverage cooler embodying the principles and concepts of the present invention and generally designated by the reference numeral 10 will be described.

More specifically, it will be noted that the first embodiment 10 of the invention includes a generally cylindrical, slightly tapering body 12 formed from an expandable stretchable material. A preferred material is sponge rubber because this provides a relatively high insulating value and also a dry, nonslip gripping surface. The body 12 has a top opening 14 communicating with a hollow interior. A conventional beverage container such as a can C may be inserted within the hollow interior of the body 12.

Figure 2:
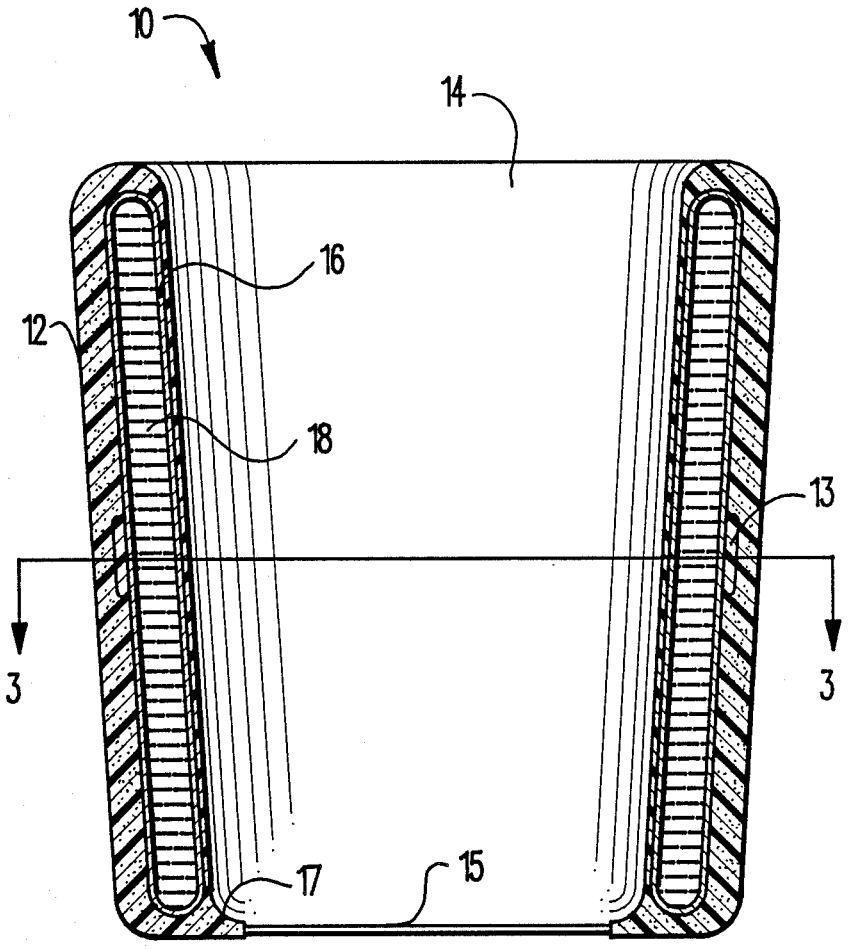
FIG. 2 is a longitudinal cross sectional view, taken along line 2—2 of FIG. 1.

As shown in the cross sectional view of FIG. 2, the body 12 is of a slightly tapering frusto conical configuration having a larger diameter open top end 14 and a smaller diameter open bottom end 15. The open ended configuration of the body 12 allows for expansion to accommodate various different sizes of beverage containers. The holder 10 of the present invention is particularly suited for use with the standard twelve ounce beverage can and also the slightly larger sixteen ounce beverage bottle. A plurality of receptacles 16 extend generally axially in a circular array within the side wall of the body 12. The receptacle 16 includes a refrigerant 18 which may include a variety of conventional materials, such as water or a gel type refrigerant. An annular rim 17 is formed within the interior of the body 12, adjacent the open bottom end 15. The annular rim 17 is adapted for abutment with a bottom peripheral edge of an inserted beverage container. An elastic band 13 extends in a circle within the side wall of the body 12 and in a circle around the array of receptacles 16. The elastic band 13 is secured at a mid portion of each of the receptacles 16.

Figure 3:
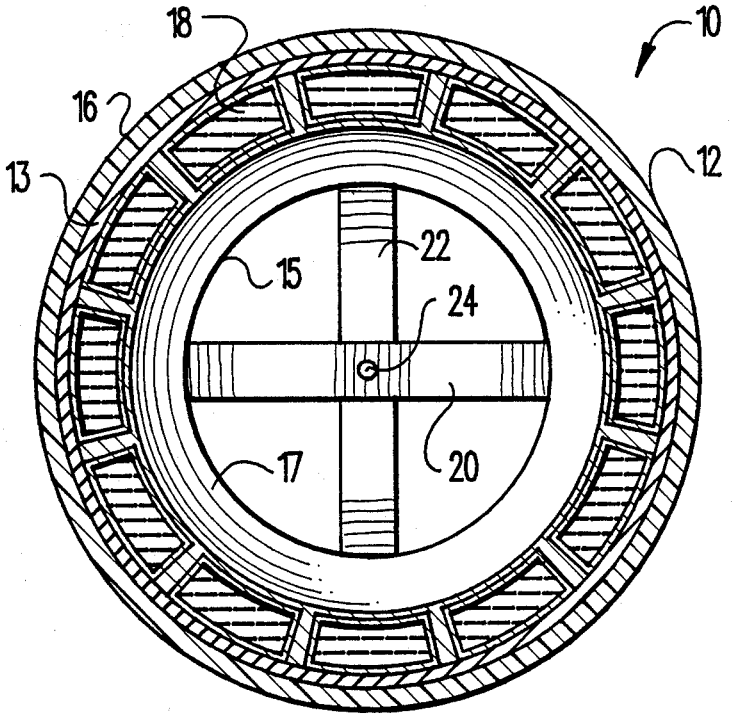
FIG. 3 is a transverse cross sectional view, taken along line 3—3 of FIG. 2.

As shown in the transverse cross sectional view of FIG. 3, each of the receptacles 16 are formed from segments of a double walled hollow cylinder. Thus, each of the receptacles 16 has an arcuately concave inner wall for conformance with the cylindrical side wall of an inserted beverage container. The receptacles 16 are slightly inclined, and are thus disposed in a frusto conical array, and are embedded within the side wall of the body 12. The elastic band 13 serves to urge the receptacles 16 together, into engagement with an inserted beverage container. The elastic band 13 also allows expansion and an increasing separation between the receptacles 16 to accommodate insertion of a larger sized beverage container. A pair of perpendicular elastic straps 20 and 22 are secured centrally at 24 and extend across the open bottom end 15 of the body 12.

Figure 4:
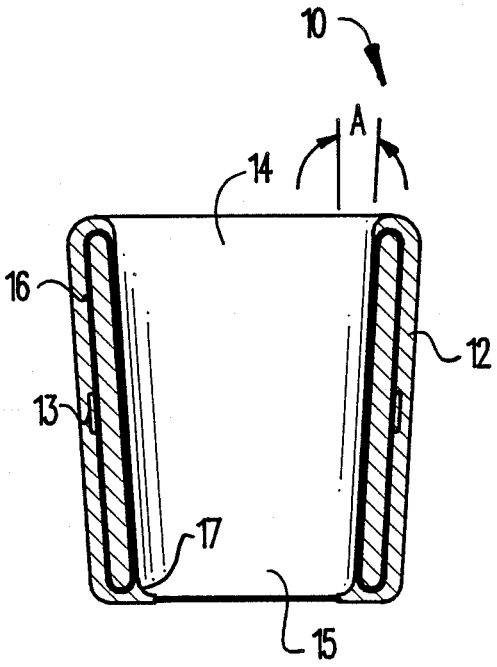
FIG. 4 is a longitudinal cross sectional view, illustrating the configuration of the cooler when not holding a beverage container.

As shown in FIG. 4, each of the receptacles 16 extends at a slight angle A with respect to the central longitudinal axis of the body 12, when no beverage container is inserted.

Figure 5:
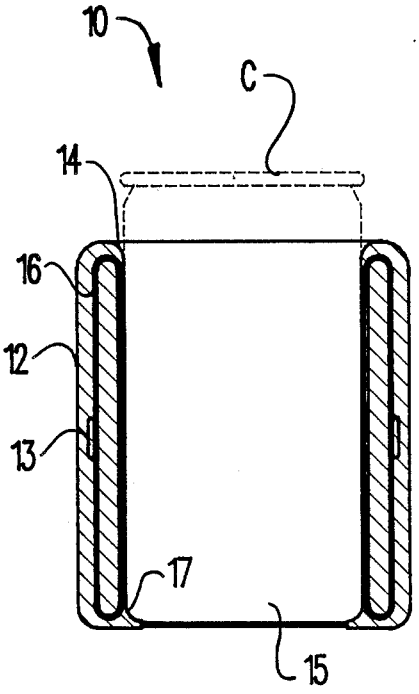
FIG. 5 is a longitudinal cross sectional view, illustrating the configuration of the holder when a beverage container is inserted therein.

FIG. 5 illustrates the configuration of the holder 10, upon insertion of a beverage container C. Because the bottom end 15 of the body 12 has an initially smaller diameter than the top end 14, the can C may be easily inserted, causing the bottom ends of each of the receptacles 16 to be forced outwardly, this in turn forces the upper ends of each of the receptacles 16 into firm engagement with the upper portion of the inserted can C. The elastic band 13 urges the receptacles 16 into engagement with the cylindrical side wall of the can C. The interior annular rim 17 within the body 12 supports the bottom of the inserted can C. Upon removal of the can C, the elastic straps 20 and 22 provide a slight bias which tends to move the upper ends of the receptacles 16 out of engagement with the top portion of the can C, thus allowing easier removal.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage cooler for holding and cooling a beverage container, comprising:

a frusto conical hollow body formed from an expandable resilient insulating material;

said body having an upper larger diameter open end and a smaller diameter bottom open end;

an annular rim formed adjacent said bottom end portion for supporting a bottom peripheral edge of a beverage container;

a plurality of discrete elongated generally axially extending receptacles spaced circumferentially in a frusto conical array and encapsulated within a side wall of said body, each of said receptacles filled with a freezable gel material;

each of said receptacles having an arcuate inner side wall for conformance with a cylindrical beverage container, said receptacles extending in a tapered frusto conical configuration tapering from a larger diameter adjacent said open upper end of said body and a smaller diameter adjacent said open bottom end of said body;

an elastic band secured around a mid portion of said receptacle, within said sidewall; and a pair of perpendicular elastic straps secured across said open bottom end of said body, whereby insertion of a cylindrical beverage container into said larger diameter open end and causes said receptacles to move into a cylindrical configuration, in close conformance with an exterior sidewall of the inserted container.

* * * * *